United States Patent [19]

Richter

[11] Patent Number: 4,949,438

[45] Date of Patent: Aug. 21, 1990

[54] TENTER CLIP WITH REPLACEABLE BUSHINGS

[75] Inventor: Hans H. Richter, Warwick, R.I.

[73] Assignee: Marshall and Williams Company, Providence, R.I.

[21] Appl. No.: 221,014

[22] Filed: Jul. 15, 1988

Related U.S. Application Data

[63] Continuation-in-part of Ser. No. 88,492, Aug. 12, 1987, abandoned, which is a continuation of Ser. No. 803,773, Nov. 29, 1985, abandoned, which is a continuation of Ser. No. 467,770, Feb. 18, 1983, abandoned.

[51] Int. Cl.[5] ..... D06C 3/02

[52] U.S. Cl. ..... 26/79; 26/93

[58] Field of Search ..... 26/73, 79, 89, 93, 94, 26/95

[56] References Cited

U.S. PATENT DOCUMENTS

| | | | |
|---|---|---|---|
| 670,598 | 3/1901 | Rusden | 26/79 |
| 1,143,989 | 6/1915 | Nolin | 26/79 |
| 1,191,512 | 7/1916 | Hoey | 26/79 X |
| 1,273,610 | 7/1918 | Hoey | 26/79 X |
| 1,822,676 | 9/1931 | Stelling | 26/79 X |
| 1,858,502 | 5/1932 | Hinnekens | 26/79 X |
| 2,065,913 | 12/1936 | Weber | 26/79 X |
| 2,096,283 | 10/1937 | Lane | 26/79 |
| 4,155,148 | 5/1979 | Richter | 26/94 |
| 4,193,175 | 3/1980 | Richter | 26/94 |
| 4,306,753 | 12/1981 | Livesay et al. | 305/57 |
| 4,787,838 | 11/1988 | Doyle | 425/515 X |

FOREIGN PATENT DOCUMENTS

| | | | |
|---|---|---|---|
| 46845 | 4/1889 | Fed. Rep. of Germany | 26/79 |
| 10005 | of 1900 | United Kingdom | 26/79 |
| 27511 | of 1902 | United Kingdom | 26/79 |
| 24027 | of 1909 | United Kingdom | 26/79 |
| 2666 | of 1914 | United Kingdom | 26/79 |
| 102325 | 11/1916 | United Kingdom | 26/79 |
| 158621 | 2/1921 | United Kingdom | 26/93 |
| 2125077 | 2/1984 | United Kingdom | 26/93 |

*Primary Examiner*—Werner H. Schroeder
*Assistant Examiner*—Bradley Kurtz DeSandro
*Attorney, Agent, or Firm*—Bailey & Hardaway

[57] ABSTRACT

A tenter clip is disclosed having a jaw which is pivotally mounted in an intermediate portion on an upper member of a housing which extends inwardly over a lower plate wherein repair of the wear points is facilitated by providing a central bushing pressed into the jaw for receiving a pin upon which the jaw is pivoted. An outwardly extending fixed controller is carried by a depending gripping portion of the jaw, and a transverse slot opens in a lower edge of the gripping portion removably receiving a gripping blade.

1 Claim, 2 Drawing Sheets

TENTER CLIP WITH REPLACEABLE BUSHINGS

This application is a continuation-in-part of parent application Ser. No. 07/088,492 filed Aug. 12, 1987, now abandoned, which application is a continuation of application Ser. No. 06/803,773, filed Nov. 29, 1985, also abandoned, which application is a continuation of application Ser. No. 06/467,770 filed Feb. 18, 1983, also abandoned.

BACKGROUND OF THE INVENTION

This invention relates to tenter clips of the type which are carried by opposed tenter chains and slide upon rails. The chains are mounted for a run with the web attached therebetween to the respective clips. Such tenter clips include a jaw which is pivotally carried in a housing which in turn includes a lower plate beneath the jaw mounting member. Often such tenter clips include controller members, carried by suitable linkage, which control the positioning of the web inserted between the jaw and lower plate member.

Such tenter clips include a pin carried by the housing upon which a movable jaw member is mounted. When such pins become worn it is customary to insert a larger pin which requires reboring the mounting portion of the housing, as well as the central bore of the bracket, to accommodate the pin within the pivoted jaw member. Another significant wear point of the tenter clip is the blade portion which confines the web beneath the movable jaw above the lower plate. Such member is generally an insert which is permanently secured in the slot within the jaw. Common practice, when the sharpened edge becomes worn, is to bevel and turn down the edge of the insert for reuse of the member. This expedient may take place only a limited number of times and such resharpening has the added disadvantage of destroying the proper alignment between the blade and the other members of the gripping jaw arrangement. The above deficiencies of such tenter clips are inherent in the structures illustrated in U.S. Pat. Nos. 1,984,616, 1,927,998, 3,058,191, and 3,514,823.

When reconditioning and repairing tenter clips and chains, it has been found that the majority of the expense involves labor and that the items referred to above account for on the order of about half of such expenses.

Accordingly, it is an important object of this invention to provide for replaceable parts which may be utilized at the major wear points of a tenter clip in order to reduce the cost of parts of labor involved in reconditioning tenter clips and chains.

SUMMARY OF THE INVENTION

It has been found that a tenter clip having a jaw pivotally mounted in an intermediate portion thereof on an upper member of a housing which extends inwardly over a lower plate may be provided with disposable means for repairing the mounting upon which the jaw is pivoted, as well as a transverse slot opening in a lower edge of the gripping portion receiving a disposable gripping blade removably secured therein for self-alignment during insertion and mounting.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a tenter clip having a jaw which is pivotally mounted in an intermediate portion on an upper member of a housing which extends inwardly over a lower plate. Central bushings A are pressed into the jaw and the intermediate portions of the upper member about which the jaw is pivotally mounted. A pin extends through the bushings about which the jaw is pivoted. An outwardly extending controller B is fixedly carried by a depending gripping portion of the jaw. A transverse slot C opens in a lower edge of the gripping portion, and a gripping blade D is removably secured in the transverse slot. An arcuate seat E is formed in the gripping portion extending into the slot, and an arcuate portion is carried by the gripping blade conforming to the arcuate seat. Fastening means secure the gripping blade in the slot after adjustment insuring that the blade conforms to the lower plate for even gripping of the web.

Figure 1:
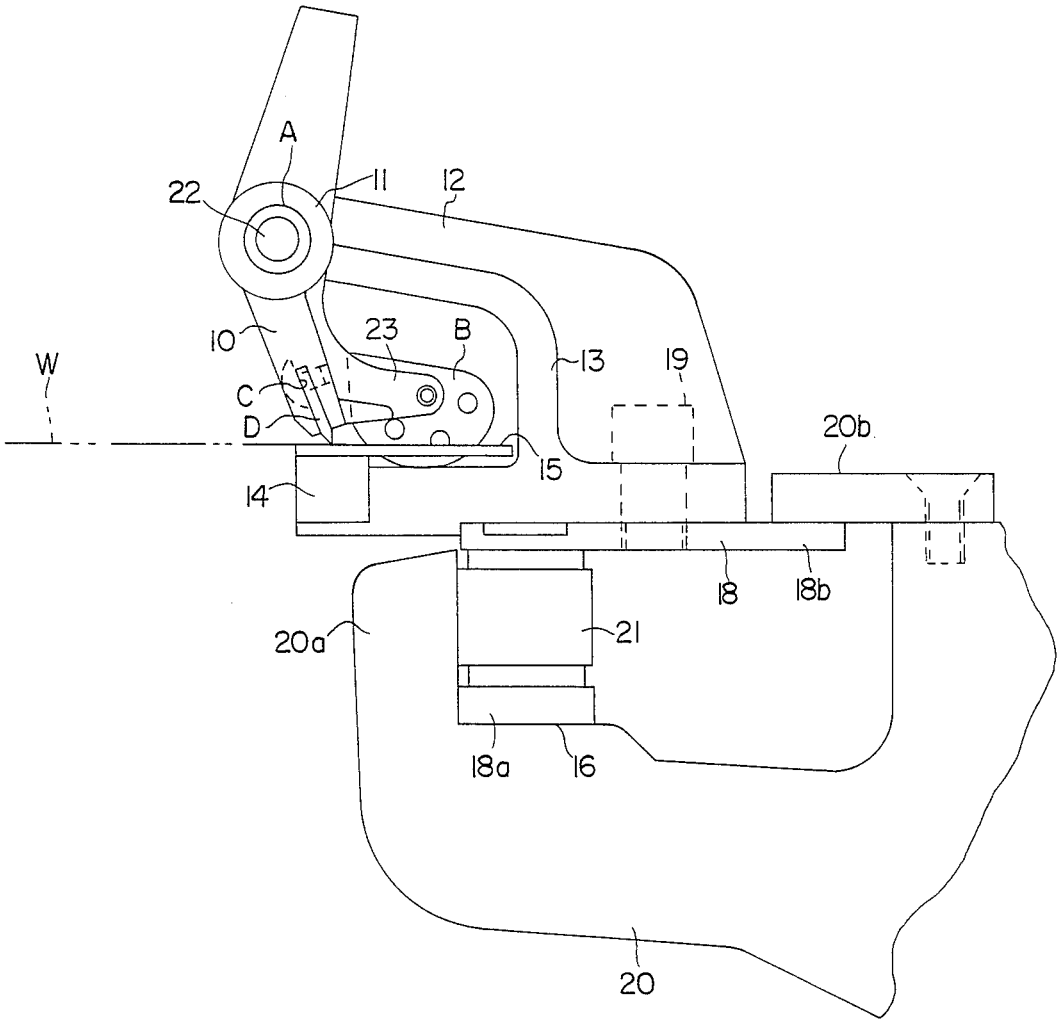
FIG. 1 is a side elevation, illustrating a tenter clip constructed in accordance with the present invention including parts which may be discarded at the wear points adjacent the pivot point of the jaw and adjacent the insert in the lower edge thereof.

A conventional tenter clip is illustrated in FIG. 1 wherein a jaw 10 is pivotally mounted in an intermediate portion thereof illustrated at 11 upon an upper bracket portion 12 of a housing 13 about a pin 22. A lower portion of the housing 13 extends inward in the form of a lower portion 14, thus forming a generally "U" shaped bracket. A wear plate 15 is provided to accommodate the web passing thereover on the upper surface of the lower member 14 thus serving as a lower plate for gripping the web illustrated in broken lines in FIG. 1. A wear portion is provided at 16 for sliding motion upon the rail 20. The sliding surface 16 is formed upon the lower portion of a customary bracket or base 18 secured to the housing 13 by the bolt 19. The base portion 18*a* which has the sliding surface 16 of the bracket 18 is carried by the rail 20 which has a side casing 20*a* for carrying the chain 21. A top casing 20*b* retains the tail 18*b* of the bracket 18.

The central bushing A is illustrated as being pressed into the central portion of the jaw to accommodate a pin 22. Similar bushings not shown are pressed into the central portion of the opposed side of the jaw and the intermediate portions of the upper member about which the jaw is mounted. Thus, bushings are fixedly carried within portions of the jaw which are pivotally carried by said pin and within portions of the upper member about which the jaw is pivotally mounted. The pin is then received centrally and transversely through the bushings. The pin is not necessarily stationary and may rotate about its axis substantially independently of the jaw and upper member so that it is, at time, stationary with respect to the upper member while the jaw pivots about it and is, at other times, stationary with respect to the jaw so that it pivots within the upper member. Thus, the bushings within the jaw and those within the upper member each receive wear only part of the time.

As is readily discernible from FIG. 1, the bushing extends axially through intermediate portion 11 of jaw 10 receiving pin 22 transversely through its entire length. Thus, jaw 10, with bushing A carried therein, pivots about pin 22. That is, pin 22 is stationary, and jaw 10 and bushing A pivot relative thereto, avoiding wear upon the intermediate portion 11 of jaw 10. The controller B is attachable in selected positions upon the bracket members 23 and is fixed therein. A transverse slot C is provided in the lower edge of the gripping portion and opens so that a lower edge of the gripping portion accommodates a gripping plate D.

Figure 2:
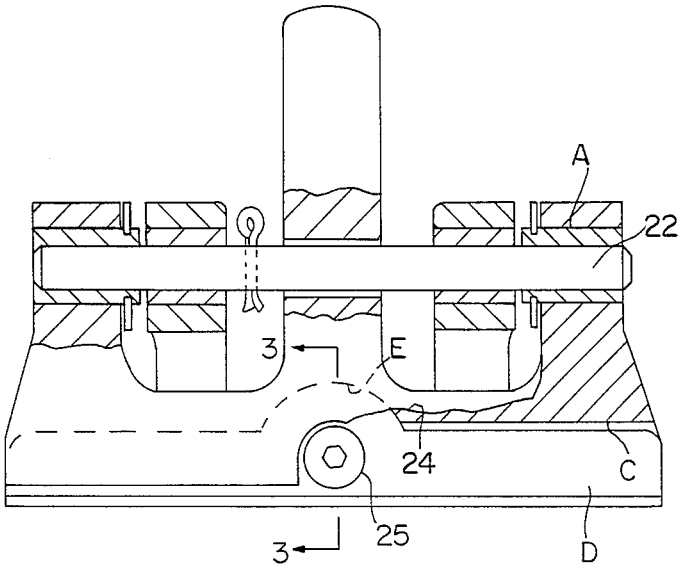
FIG. 2 is a front elevation with parts broken away, illustrating the removable, self-aligning blade.
Figure 3:
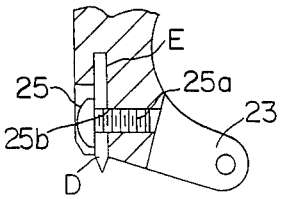
FIG. 3 is a sectional elevation taken on line 3—3 in FIG. 2.

Referring now to FIGS. 2 and 3, it will be noted that the slot C has an arcuate seat E formed in the gripping portion extending therein.

An arcuate seat E is formed in the gripping portion by the gripping blade conforming thereto. Suitable fastening means illustrated as a bolt 25 secures the gripping blade in the slot after adjustment insuring that the blade conforms to the lower plate for even gripping of the web. The fastening means 25 has a threaded shank 25*a* which extends through an opening 25*b* in the central portion of the blade assuring gripping of the blade, securing same within the slot in self-adjusted position.

While a preferred embodiment of the invention has been described using specific terms, such description is for illustrative purposes only and it is to be understood that changes and variations may be made without departing from the spirit or scope of the following claims.

What I claim is:

1. A tenter clip carried by a chain upon a tenter rail comprising:

a substantially U-shaped housing including an upper member extending inwardly over a lower plate;

a jaw pivotally carried by said upper member having a depending portion for gripping a web against said lower plate;

a pin carried transversely of said upper member upon which said jaw is pivotally carried;

said pin extending transversely through said jaw and said upper member;

central axial transverse bushings fixedly pressed into portions of said jaw pivotally carried concentrically of said bushing by said pin and fixedly pressed into portions of said upper member receiving said pin centrally and transversely thereof for pivotal movement whereby wear is received by said bushings and said pin avoiding wear upon said jaw and said upper member, said bushings and said pin being easily replaceable once worn; and an outwardly extending controller carried by said depending portion of said jaw.

* * * * *